US007490499B2

(12) United States Patent
Suzuki et al.

(10) Patent No.: US 7,490,499 B2
(45) Date of Patent: Feb. 17, 2009

(54) TUBE EXPANDING DEVICE

(75) Inventors: Tetsuya Suzuki, Uozu (JP); Katsuyuki Teranushi, Uozu (JP)

(73) Assignee: Sugino Machine Limited, Tayama (JP)

( * ) Notice: Subject to any disclaimer, the term of this patent is extended or adjusted under 35 U.S.C. 154(b) by 164 days.

(21) Appl. No.: 11/600,343

(22) Filed: Nov. 15, 2006

(65) Prior Publication Data

US 2007/0204666 A1 Sep. 6, 2007

(30) Foreign Application Priority Data

Mar. 1, 2006 (JP) ..... 2006-055124

(51) Int. Cl.
*B21D 3/02* (2006.01)

(52) U.S. Cl. ..... 72/122; 72/126

(58) Field of Classification Search ..... 72/118, 72/120, 122, 123, 125, 126, 370.06, 370.07, 72/370.08, 393, 117
See application file for complete search history.

(56) References Cited

U.S. PATENT DOCUMENTS 3,854,314 A * 12/1974 Martin ..... 72/122
3,906,771 A * 9/1975 Martin ..... 72/122
4,319,472 A * 3/1982 Martin ..... 72/122
4,615,198 A * 10/1986 Hawkins et al. ..... 72/122
4,658,616 A * 4/1987 Bastone ..... 72/21.4
4,716,752 A * 1/1988 Diller ..... 72/118

FOREIGN PATENT DOCUMENTS

JP 1-143632 10/1989
JP 7-15128 3/1995
JP 7-290171 11/1995

* cited by examiner

*Primary Examiner*—Edward Tolan
(74) *Attorney, Agent, or Firm*—Merchant & Gould P.C.

(57) ABSTRACT

A tube expanding device includes: a plurality of rollers each having a tapered portion whose diameter increases toward its front side; a cylindrical expander frame for freely rotatably holding the plurality of rollers on a concentric circle; a mandrel inserted in the expander frame so as to be freely slidable and rotatable relative to the expander frame, and having a tapered portion whose diameter decreases toward its front side, the tapered portion of the mandrel matching the tapered portion of each roller; a drive device coupled to the expander frame and rotating the expander frame; and a moving device for moving the mandrel forward and backward relative to the expander frame. By moving the mandrel forward relative to the expander frame, the tapered portion of the mandrel abuts on the tapered portions of the plurality of rollers and thereby expands a diameter of a circumscribed circle formed by the plurality of rollers.

22 Claims, 7 Drawing Sheets

TUBE EXPANDING DEVICE

CROSS REFERENCE TO RELATED APPLICATIONS

This application claims the foreign priority benefit under Title 35, United States Code, §119(a)-(d) of Japanese Patent Application No. 2006-055124, filed on Mar. 1, 2006 in the Japan Patent Office, the disclosure of which is herein incorporated by reference in its entirety.

BACKGROUND OF THE INVENTION

The present invention relates to a tube expanding device that expands tubes from the inside diameter thereof.

Generally, in the process of manufacturing an heat exchanger such as a boiler, condenser, or radiator, when a tube is joined and fixed to a tube plate, tube expanding tools are used for expanding tubes from the inside diameter and pressing it against the tube plate (e.g., see Japanese Laid-open Utility Model Publication No. H07-15128, Japanese Laid-open Patent Publication No. H07-290171, and Japanese Laid-open Utility Model Publication No. H01-143632).

For example, the tube expanding tool described in the above-mentioned Publication No. H07-15128 is constructed so that an operator couples the tube expanding tool to a rotary drive machine to rotate rollers, and by pressing the rollers against the inner peripheral surface of the tube and rolling them, a tube expanding operation can be simply performed. With this tube expanding tool, the expanded portion of the tube is formed with a smooth continuous surface whose radius of curvature is small, so a finish of high-quality tube expanding that maintains a true circular shape is possible.

The construction of the tube expanding tool described in the above-mentioned Publication No. H07-15128 will be explained concretely with reference to FIGS. 7A and 7B, in which FIG. 7A is a sectional view for explaining a conventional tube expanding tool, and FIG. 7B is a part-plan view showing the positional relation between a roller and a mandrel.

As shown in FIG. 7A, the tube expanding tool 121 includes a tapered mandrel 123 formed integrally with a coupling portion 122 that is coupled to a rotary drive machine (not shown); a plurality of rollers 124 with a reverse taper shape conforming to the taper shape of this mandrel 123; and a frame 125 for freely rotatably holding the rollers 124 on the outer peripheral surface of the mandrel 123.

As the rotary drive machine to which the tube expanding tool 121 is coupled, a manually operated type rotary drive machine is generally used, which is held by operator's hands during a tube expanding operation and includes a controller for controlling the rotation and stop of the rotary drive machine by detecting a load torque during the tube expanding operation.

As shown in FIG. 7A, in the tube expanding tool 121 constructed as described above, if the mandrel 123 coupled to the rotary drive machine is moved forward relative to the frame 125 by an operator, that portion of the mandrel 123 which is large in outside diameter abuts on the rollers 124 gradually and therefore the rollers 124 are pushed out radially outward from the outer peripheral surface of the frame 125 and are pushed against the inner peripheral surface of the tube TU. In this state, if the mandrel 123 is caused to make positive rotation (rotation in an A direction, i.e., right-handed rotation as viewed forward from the rear end of the tool) by the rotary drive machine, the rollers 124 revolve around the mandrel 123 in the clockwise direction (the same direction as the direction of rotation of the mandrel 123) while making reverse rotation (rotation in an R direction, i.e., left-handed rotation as viewed forward from the rear end of the tool).

That is, by rotating the mandrel 123 by the rotary drive machine (not shown), the rollers 24 are rotated, and when the rollers 124 is being revolved around the mandrel 123 together with the frame 125, the rollers 124 are rolled on the inner peripheral surface of the tube TU, whereby an expanded diameter is formed (this rotating system is referred to as a mandrel rotating system).

As shown in FIG. 7B, each roller 124 is held at a feed angle θ to the mandrel 123 by the frame 125 (see FIG. 7A), so if the rollers 124 are reversely rotated, the mandrel 123 is moved forward. As a result, the rollers 124 are automatically pushed out outward from the outer peripheral surface of the frame 125.

However, in the tube expanding tool 121 of the conventional mandrel rotating system, the mandrel 123 is rotated by the rotary drive machine, and the rollers 124 are rotated by the rotation of the mandrel 123, so that the frame 125 is rotated by revolving the rollers 124 around the mandrel 123. For that reason, the rollers 124 perform a planetary gears motion between the inner peripheral surface of the tube TU and the mandrel 123.

Therefore, by the principles of the planetary gears motion, the rotation speed of the frame 125 is reduced to about ⅓ to ⅕ of that of the mandrel 123, depending upon the diameters of the mandrel 123 and roller 124. For that reason, there has been a problem that the rotation speed of the roller 124 (frame 125) does not increase, while the tube expanding operation is time-consuming and the working efficiency is low.

Hence, to raise the rotation speed of the roller 124, it is conceivable to raise the rotation speed of each rotary drive machine, but in this case, runout of the mandrel 123 and rollers 124 will occur and cause vibrations. For that reason, forming quality such as a degree of true circle deteriorates and a burden to an operator becomes great. Besides, if the rotation speed of the rotary drive machine is raised, after the tube expanding operation the braking reaction force in stopping the rotary drive machine will become great, thereby resulting in a reduction in the working efficiency and handling convenience.

On the other hand, if the feed angle θ is made larger to shorten the tube expanding time, an angle at which the axis of rotation of the roller 124 intersects the axis of rotation of the tube TU becomes larger and the formed shape of the tube expanded portion EX is easy to become a hand drum shape whose central portion is dented. For that reason, there is a possibility that the problem of strength and airtightness in joining and fixing the tube TU to the tube plate will occur.

In addition, if the taper angle of the taper-shaped mandrel 123 is made larger to shorten the tube expanding time, the mandrel 123 must be pushed strongly to an extent that the forward movement of the mandrel 123 is reduced. For that reason, a load applied to each member increases and results in shortening of the life time of the tube expanding tool.

Besides, the controller connected to the tube expanding tool 121 is used for controlling the operation from the state in which the mandrel 123 has abutted on the rollers 124 to the state in which the rollers 124 has been pushed out by the mandrel 123. For that reason, the process of abutting the mandrel 123 on the rollers 124 and separating the mandrel 123 from the rollers 124 must be performed before and after tube expanding by the operator. Particularly, the operation of separating the mandrel 123 from the rollers 124 requires a great force and results in a burden to the operator, because the mandrel 123 is pushed against the rollers 124.

The aforementioned tube expanding tool 121 requires dedicated couplings to connect the coupling portion 122 and the rotary drive machine together. For that reason, the number of components increases and a time-consuming connection work is required. Moreover, chatter of the connecting portion sometimes occurs, thereby resulting in a contact turn of the connecting portion.

Furthermore, since the operation of pushing the mandrel 123 against the rollers 124 and separating the mandrel 123 from the rollers 124 is manually performed, a great deal of work load is required by the operator.

SUMMARY OF THE INVENTION

To solve the aforementioned problems, the present invention has been made to provide a tube expanding device, which is capable of shortening a tube expanding time by improving its working efficiency, and which can decrease the work load of the operator while performing a tube expanding operation with a high degree of accuracy.

According to the present invention, there is provided a tube expanding device comprising: a plurality of rollers each having a tapered portion whose diameter increases toward its front side; a cylindrical expander frame for freely rotatably holding the plurality of rollers on a concentric circle; a mandrel inserted in the expander frame so as to be freely slidable and rotatable relative to the expander frame, and having a tapered portion whose diameter decreases toward its front side, the tapered portion of the mandrel matching the tapered portion of each roller; a drive device coupled to the expander frame and rotating the expander frame; and a moving device for moving the mandrel forward and backward relative to the expander frame. By moving the mandrel forward relative to the expander frame, the tapered portion of the mandrel abuts on the tapered portions of the plurality of rollers and thereby expands a diameter of a circumscribed circle formed by the plurality of rollers.

This drive device for rotating the expander frame is intended to mean a device which transmits the driving force directly to the expander frame. That is, the drive device differs in construction from the conventional drive unit that transmits the rotary driving force of the rotary drive machine to the frame through the mandrel and rollers.

With this construction of the tube expanding device, the driving force of the drive device can be transmitted directly to the expander frame without being transmitted through the mandrel and rollers, so the expander frame can be rotated at high speed without reducing the rotation speed.

Also, with this construction including the drive device and the moving device, the connection of the expander tool with the rotary drive machine for each tube expanding operation and the use of dedicated couplings are not required, unlike the conventional tube expanding tool. As a result, the occurrence of chatter and the contact turn can be prevented and a work load of the operator can be decreased. Furthermore, by providing the mandrel moving device, the operation of pushing the mandrel against the rollers and separating the mandrel from the rollers can be automatically performed, whereby a work load to the operator can be further decreased.

In the aforementioned tube extender, the moving device may comprise a roller feed unit including: a cylindrical retainer coupled to the drive device; a push rod inserted in the retainer, and coupled to the mandrel so as to be freely movable forward and backward together with the mandrel; and a plurality of rollers freely rotatably supported by the retainer, and arranged such that an outer peripheral surface of each roller abuts on an outer peripheral surface of the push rod while an axis of rotation of each roller intersects with an axis of rotation of the push rod.

The push rod coupled to the mandrel means a push rod which is coupled to the mandrel in such a manner to be relatively rotatable about its axis relative to the mandrel. The mandrel moves forward and backward together with the push rod, but the rotation speed may differ from that of the push rod.

With this construction of the tube expanding device, the mandrel can be moved forward and backward with a simple construction and a simple operation such as by changing the direction of rotation of the retainer, and therefore members such as a return spring for moving the mandrel backward can be saved.

The aforementioned tube expanding device may further comprise a controller for controlling forward and backward movements of the mandrel according to a driving torque for moving the mandrel forward relative to the expander frame, and the controller may perform a control of stopping the mandrel for a predetermined period of time and then moving the mandrel backward when the driving torque has reached a predetermined value.

With this construction of the tube expanding device, the operation up to the separation of the mandrel from the rollers can be fully automated. Therefore, after the stop of the tube expanding device, the extreme end of the tube expanding device can be pulled out immediately from a tube which is a tube member to be expanded, thereby greatly improving the working efficiency. In addition, since the mandrel is stopped when a driving torque has reached a predetermined value, an expanded tube diameter can be kept constant, whereby the tube expanding operation can be performed with a high degree of accuracy.

In the aforementioned tube expanding device, the drive device may include a drive motor, and a cylindrical spindle which is rotated by an output of rotation transmitted from the drive motor, and the mandrel is inserted in the spindle, and the expander frame is fixed to a front portion of the spindle.

With this construction of the tube expanding device, the mandrel and spindle are arranged so that they are overlapped each other in the direction of the length, so the forward and backward strokes of the mandrel can be housed within the drive device. As a result, the entire length of the tube expanding device can be shortened, and therefore a reduction in size of the whole device can be achieved and a working efficiency is also improved.

In the aforementioned tube expanding device, the retainer of the roller feed unit may be fixed to a rear portion of the spindle.

With this construction of the tube expanding device, the drive of the moving device and the drive of the drive device can be performed with the same drive source, whereby simplifying the structure, size reduction and weight reduction of the tube expanding device, simplifying the control system, and an improvement in reliability can be achieved.

In the aforementioned tube expanding device, a collar member which abuts on an end face of a tube member to be expanded may be arranged outside the expander frame, with a predetermined gap formed between the collar member and an outer peripheral surface of the expander frame so as to surround the expander frame, and the collar member may be fixed to a fixed system.

With this construction of the tube expanding device, since the collar member does not rotate, it is possible to obtain a rotation-preventive function for stopping a turn of a tube which abuts on the collar member. This can improve the working accuracy, and the work load of the operator for stopping a turn of the tube member to be expanded can be decreased, and further a separate member such as an attachment can be saved.

BRIEF DESCRIPTION OF THE DRAWINGS

The aspects of the present invention will become more apparent by describing in detail illustrative, non-limiting embodiment thereof with reference to the accompanying drawings, in which.

DETAILED DESCRIPTION OF THE PREFERRED EMBODIMENTS

A preferred embodiment of the present invention will be explained in detail with reference to the accompanying drawings.

The preferred embodiment will be explained, assuming that the extreme end side (left side in FIG. 1) of an expander frame to be inserted into a tube (which is a tube member to be expanded) is a front side and the proximal side (right side in FIG. 1) is a rear side.

Figure 1:
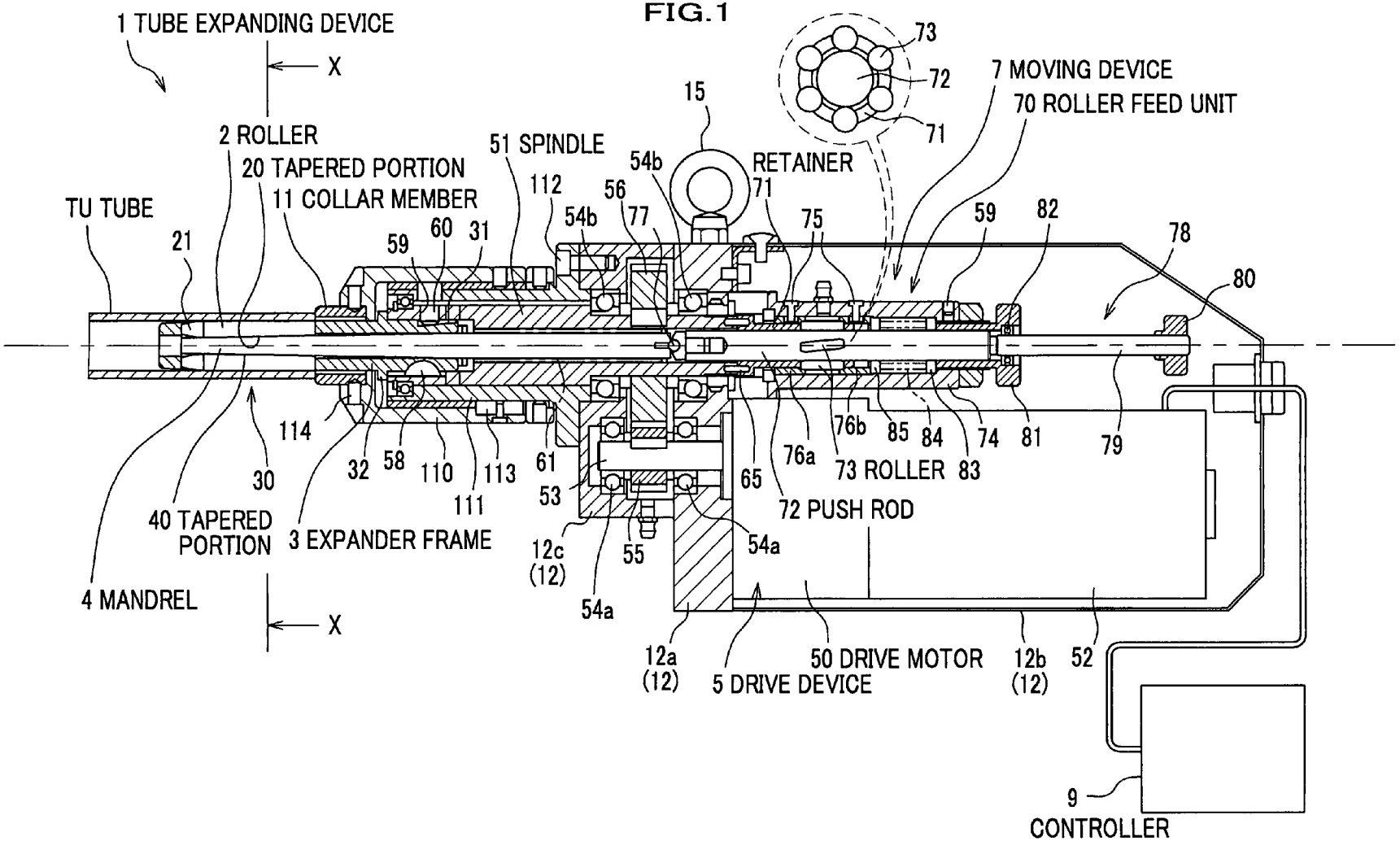
FIG. 1 is a sectional view showing a tube expanding device according to one preferred embodiment of the present invention.

As shown in FIG. 1, the tube expanding device 1 according to the preferred embodiment includes a plurality of rollers 2 each having a tapered portion 20 whose diameter increases toward its front side; a cylindrical expander frame 3 for freely rotatably holding the plurality of rollers 2 on a concentric circle; and a mandrel 4 inserted in the expander frame 3 so as to be freely slidable and rotatable relative to this expander frame 3, and having a tapered portion 40 whose diameter decreases toward its front side. The tapered portion 40 of the mandrel matches the tapered portion 20 of each roller 2. In the tube expanding device 1, by moving the mandrel 4 forward relative to the expander frame 3, the tapered portion 40 of the mandrel 4 abuts on the tapered portions 20 of the rollers 2, and thereby expanding a diameter of a circumscribed circle formed by these rollers 2.

Particularly, in the present invention, the tube expanding device 1 further includes a drive device 5, coupled to the expander frame 3, for rotating the expander frame 3, and a moving device 7 for moving the mandrel 4 forward and backward relative to the expander frame 3.

The roller 2 is a component used for giving rolled-plastic deformation to the tube TU (which is a tube member to be expanded) from inside, and has the tapered portion 20 increasing in diameter from its rear side toward its front side. This tapered portion 20 is reversely tapered so as to match the shape of the tapered portion 40 of the mandrel 4, and is constructed such that the inside surface of the tube TU expanded becomes a true circle at all times. Therefore, the tapered portions 20 of the rollers 2 enable a parallel tube expanding. The front end portion of the roller 2 is formed into a chamfered portion 21 whose radius of curvature is large, thereby avoiding concentration of stress after tube expanding and also preventing sharp-edged portions from occurring in the inside surface of the tube TU.

The expander frame 3 is formed into a cylindrical shape, into which the mandrel 4 is inserted. The rear side of the expander frame 3 is fixed to a spindle 51 to be described later, while the front side is protruded forward from a color member 11. The protruding portion 30 is constructed so that it can be inserted into the tube TU. On the body portion of the protruding portion 30 of the expander frame 3, the plurality of rollers 2 are held so that they are freely movable and rotatable into and out of the outer peripheral surface of the expander frame 3.

The expander frame 3 inclines and holds the rollers 2 at a predetermined feed angle so that the axis of rotation of the roller 2 and the axis of rotation of the mandrel 4 intersect when viewed from the radial outside toward the center side. The direction of the feed angle is set so that, when the expander frame 3 makes positive rotation (rotation in an A direction shown in FIG. 4 (clockwise rotation as viewed forward from the rear side)), the mandrel 4 moves forward. The magnitude of the feed angle is suitably determined, taking into consideration the load torque required for tube expanding, the forward and backward moving speeds of the mandrel 4 by the moving device 7, and the like.

Figure 2:
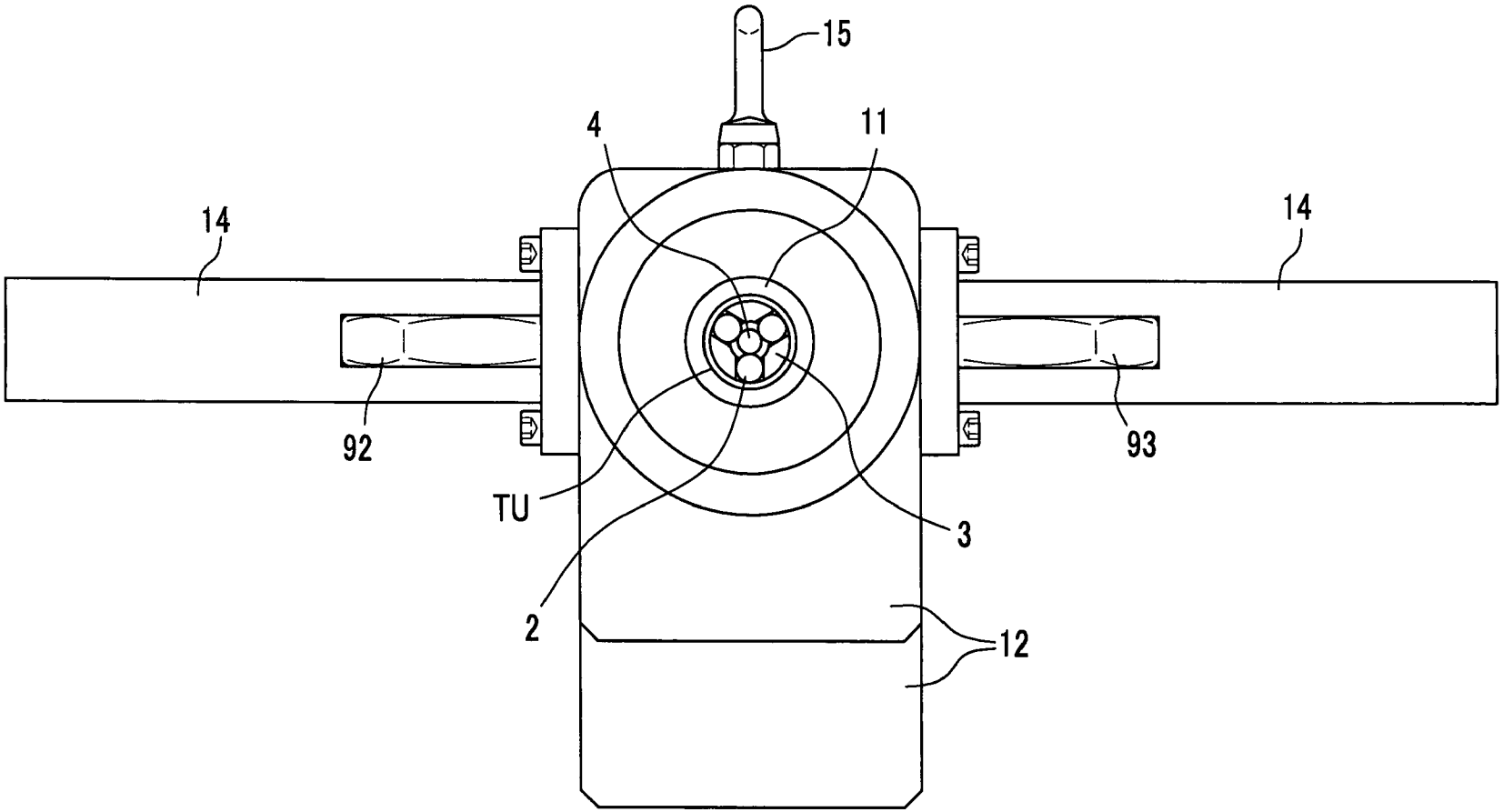
FIG. 2 is a front view showing the tube expanding device of FIG. 1.
Figure 4:
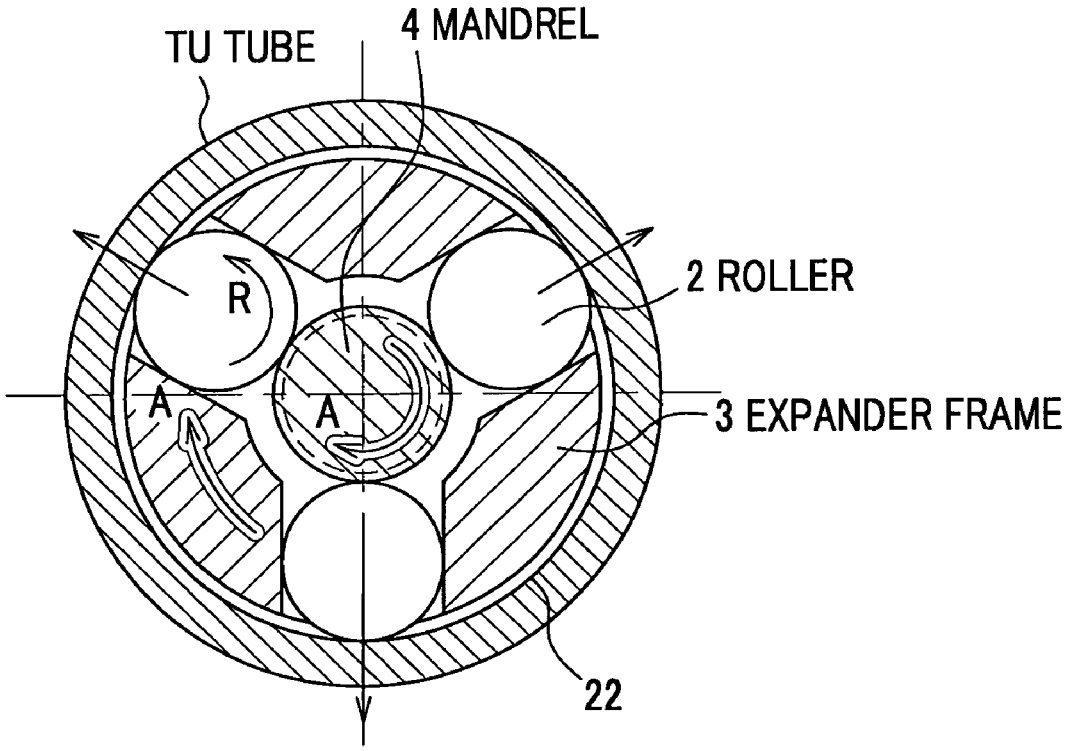
FIG. 4 is a sectional view of the tube expanding device taken along the line X-X of FIG. 1.

The rollers 2 held by the expander frame 3, as shown in FIGS. 2 and 4, are disposed at three places at equal angle pitches (120-degree pitches) on the circumference of the expander frame 3 and on a concentric circle. The front side of the rotation axis of the roller 2 inclines toward the rotation axis side of the expander frame 3 and is arranged, in such a manner that the expanded tube diameters (tool diameters) formed by the circumscribed circle 22 of these three rollers 3 are constant in the axial direction of the expander frame 3. In the preferred embodiment, the rollers 3 are arranged at three places, but the present invention is not limited to this specific embodiment. The number and arrangement of rollers 2 are suitably determined according to conditions such as the diameter and strength of the tube TU.

As shown in FIG. 1, the mandrel 4 is inserted in the expander frame 3 which is formed into a cylindrical shape, and is provided so as to be rotatable and slidable (movable in forward and backward directions) in the axial direction relative to the expander frame 3. The mandrel 4 has the tapered portion 40 that becomes small in diameter at its front side and large in diameter at its rear side. This tapered portion 40 is formed so as to match the tapered portion 20 of the roller 2, so that the outer peripheral surface of the roller 2 and the outer peripheral surface of the mandrel 4 can contact each other. Thus, the front side of the mandrel 4 is freely rotatably supported by the expander frame 3 through the rollers 2. The rear portion of the mandrel 4 is in the form of a column having a constant outside diameter throughout the axial direction thereof, and the moving device 7 is coupled with the rear end thereof.

It is noted that that the rollers 2 and the mandrel 4 have undergone a thermal process and a surface grinding finish process in order to improve pressure resistance and wear resistance.

The drive device 5 includes a drive motor 50 and a cylindrical spindle 51 which is rotated by an output of rotation transmitted from the drive motor 50. The front portion of the spindle 51 is fixed to the expander frame 3 so that the expander frame 3 rotates integrally with the spindle 51, and the mandrel 4 which is axially protrudes from the rear end of the expander frame 3 is inserted into the spindle 51. On the outer peripheral surface of the mandrel 4, a return spring 61 is provided for urging the mandrel 4 backward. The front end portion of the return spring 61 is fixed to the inner peripheral surface of the spindle 51, while the rear end portion is fixed to the outer peripheral surface of the mandrel 4. The return spring 4 fulfils an auxiliary role in separating the mandrel 4 from the rollers 2. However, since forward and backward movements of the mandrel 4 can be performed by the moving device 7, the return spring 4 may be omitted.

The drive motor 50 employs a commutator motor 52 and is enclosed within a housing 12 constituting the outer shell of the tube expanding device 1. The housing 12 includes a base portion 12*a* for holding the front side of the drive motor 50, a cover portion 12*b* for covering the rear portion of the drive motor 50, and a head portion 12*c* for covering the motor shaft 53 of the drive motor 50. With the motor shaft 53 extending forward, the drive motor 50 is arranged to be parallel to the mandrel 4. The motor shaft 53 is freely rotatably supported on the inside surfaces of the base portion 12*a* and the head portion 12*c* (housing 12) through ball bearings 54*a*. The outer peripheral surface of the motor shaft 53 is provided with a gear 55.

The spindle 51 is arranged concentrically with the mandrel 4 and is freely rotatably supported on the inside surfaces of the base portion 12*a* and the head portion 12*c* (housing 12) through ball bearings 54*b*. The outer peripheral surface of the spindle 51 is provided with a gear 56 meshing with the gear 55 of the motor shaft 53. The gear 56 of the spindle 51 is made larger in diameter than the gear 55 of the motor shaft 53. As a result, rotation is transmitted with the driving torque of the drive motor 50 increased, and the control of the rotation speed of the spindle 51 is facilitated. The rear end portion of the expander frame 3 is inserted into the front end portion of the spindle 51. The inner peripheral surface of the spindle 51 has an axially extending key way (not shown), in which a woodruff key 58 is fitted to transmit rotating force to the expander frame 3. The woodruff key 58 is also fitted in the outer peripheral surface of the expander frame 3, whereby rotating force is transmitted from the spindle 51 through the woodruff key 58 and to the expander frame 3. The rear end portion of the outer peripheral surface of the expander frame 3 has an axial groove 31 that becomes deeper toward its front end, and if a stopper screw 60 inserted in a screw hole 59 formed in the spindle 51 is pressed against the surface of the groove 31, the expander frame 3 is fixed not to slip out of the spindle 51. The outer peripheral surface of the expander frame 3 has a flange portion 32, and if the flange portion 32 abuts on the front end face of the spindle 51, the flange portion 32 fulfils a role as a positioning stopper upon inserting the expander frame 3 into the spindle 51.

It is noted that while the drive motor 50 is arranged in parallel with the mandrel 4, the present invention is not limited to this specific arrangement. If a means for transmitting rotation of the motor shaft 53 to the spindle 51 is employed, the drive motor 50 may be arranged at an angle to the mandrel 4.

The moving device 7 is a device for moving the mandrel 4 forward and backward relative to the expander frame 3, and in this preferred embodiment, the moving device comprises a so-called roller feed unit 70. The roller feed unit 70 is arranged above the drive motor 50 and behind the mandrel 4. The roller feed unit 70 includes a cylindrical retainer 71, a push rod 72 inserted into this retainer 71 so as to be freely movable forward and backward, a plurality of rollers 73 freely rotatably supported by the retainer 71 and arranged such that the outer peripheral surface of each roller 73 abuts on the outer peripheral surface of the push rod 72 while the rotation axis of each roller 73 intersects the rotation axis of the push rod 72, and a cylindrical frame 74 for freely rotatably supporting the retainer 71.

The cylindrical frame 74 is arranged coaxially with the spindle 51, at the rear side of the spindle 51. The front end face of the cylindrical frame 74 is fixed to the rear surface of the base portion 12*a*. The cylindrical frame 74 is arranged with a predetermined gap provided so as to cover the outer peripheral surface of the retainer 71.

The retainer 71 is arranged coaxially with the spindle 51, at the rear side of the spindle 51. The retainer 71 abuts on the rear end face of the spindle 51 at its front end face and is fixed to the spindle 51 through a plurality of pins 65, arranged on the circumference of a circle, and therefore the retainer 71 rotates integrally with the spindle 51.

A plurality of rollers 73 are held on the body portion of the retainer 71 so that they are freely rotatable. The retainer 71 inclines and holds the rollers 73 at a predetermined feed angle so that the rotation axis of each roller 73 and the rotation axis of the retainer 71 intersect when viewed from the radial outside toward the center side. The direction of the feed angle, as with the roller 2 of the expander frame 3, is set so that when the retainer 71 makes positive rotation, the push rod 72 moves forward.

Each roller 73 held by the retainer 71 is formed into the shape of a column. As shown in an enlarged diagram of the top portion of the tube expanding device 1 of FIG. 1, the rollers 73 are arranged at six places at equal angle pitches (60-degree pitches) on the circumference of the retainer 71. Each roller 73 has a diameter larger than the thickness of the retainer 71. The rollers 73 thus arranged on the concentric circle are constructed such that the inscribed circle thereof conforms to the outer peripheral surface of the push rod 72 and the circumscribed circle thereof projects radially outward from the outer circumferential surface of the retainer 71. The front and rear end portions of the roller 73 are chamfered so that they have a curved surface. Around the portion of the retainer 71 in which the roller 73 is arranged, there are provided abutting members 76*a*, 76*b* which abut on the roller 73. The abutting members 76*a*, 76*b* are formed into a ring shape and fixed to the inner peripheral surface of the cylindrical frame 74 through pins 75. The abutting members 76*a*, 76*b* are provided at two places before and after the roller 73, and are constructed such that they respectively abut on the chamfered portions of the front and rear end portions of the rollers 73. With this arrangement, when the retainer 71 rotates, the rollers 73 revolve on the circumference of the retainer 71 while abutting on the abutting members 76*a*, 76*b*. Therefore, the roller 73 also rotates about its axis. The rear abutting member 76*b* has an axially elongated groove in which the pin 75 fits. Namely, although the rear abutting member 76*b* does not rotate, the axial length can be adjusted.

In this preferred embodiment, while the rollers 73 are arranged at six places, the present invention is not limited to the six rollers 73 but the number of rollers 73 may be at least three. The number and arrangement of rollers 73 are suitably determined according to conditions such as a tube expanding speed, etc. If the feed angle of the roller 73 is made larger, the speed at which the push rod 72 and mandrel 4 are pushed out can be increased and therefore the time required for the rollers 2 to abut on the inner peripheral surface of the tube TU can be shortened. In this case, after the rollers 2 have abutted on the inner peripheral surface of the tube TU, self-propulsive force acts on the mandrel 4. As a result, a difference occurs between the self-propulsive force of the mandrel 4 and the propulsive speed of the push rod 72. However, since the self-propulsive force of the mandrel 4 is by far greater than the self-propulsive force of the push rode 72, the rollers 73 slip on the push rod 72 and therefore the push rod 72 is propelled at the same propulsive speed as the mandrel 4. The propelled amount of the mandrel 4 and the propelled amount of the push rod 72 are thus automatically synchronized without requiring any particular synchronizing means.

The push rod 72 is formed into the shape of a column with the same outside diameter as the inscribed circle of the rollers 73 arranged on a concentric circle. The push rod 72 is held by a plurality of rollers 73 arranged to surround the outer peripheral surface of the push rod 72. The outer peripheral surface of the roller 73 and the outer peripheral surface of the push rod 72 abut on each other and are preloaded so that rotation of the roller 73 can be transmitted to the push rod 72. Since the rotation axis of the roller 73 is arranged to intersect the rotation axis of the push rod 72, the push rod 72 moves forward and backward in the axial direction, when the rollers 73 are rotated.

At the rear side of the mandrel 4, the push rod 72 is arranged coaxially with the mandrel 4. The front end of the push rod 72 is coupled with the mandrel 4 such that the mandrel 4 is allowed to rotate about its axis relative to the push rod 72. Specifically, the front end of the push rod 72 and the rear end of the mandrel 4 are coupled together through a spherical bearing 77. Therefore, the mandrel 4 moves according to forward and backward movements of the push rod 72.

The rear end of the push rod 72 is provided with a stopper 78 for regulating a forward movement of the push rod 72. The stopper 78 includes a rear end rod 79 coupled to the rear end of the push rod 72, a flange portion 80 provided on the rear portion of the rear end rod 79, and a sleeve 81 against which the flange portion 80 abuts. The rear end rod 79 is smaller in diameter than the push rod 72 and is fixed to the push rod 72 by pins (not shown) or the like. It is noted that the rear end rod 79 may be formed integrally with the push rod 72. The sleeve 81 is arranged coaxially with the push rod 72, and the front portion thereof is inserted into the rear end portion of the cylindrical frame 74 and fixed through a stopper screw 59. The front portion of the sleeve 81 is inserted into the cylindrical frame 74 so as to cover the push rod 72, while the rear portion of the sleeve 81 projects rearward from the cylindrical frame 74. The rear end portion of the inner peripheral surface of the sleeve 81 is provided with a ball bearing 82 for freely rotatably holding the rear end rod 79 while allowing an axial movement of the rod 79. When the rear end rod 79 moves forward and the stopper 80 abuts on the ball bearing 82, the forward movement is restricted and the rotational thrust is alleviated. The front face of the sleeve 81 is provided with a first thrust ring 83. In front of the first thrust ring 83, there is provided a second thrust ring 85 fixed to the inner peripheral surface of the cylindrical frame 74. A spring 84 is interposed between the thrust rings 83, 85, and when screwing the sleeve 81 into the cylindrical frame 74, the spring 84 is compressed. By pushing the rear abutting member 76*b*, adjustment can be made on the spring 84 for a pushing force (contact friction force) for pushing the roller 73 against the push rod 72. By adjusting the screwed amount of the sleeve 81, the propulsive force of the push rod 72 can be adjusted and the function of a safety device by sliding can be obtained.

The roller feed unit 70 including the stopper 78 to be constructed as above, is enclosed within the housing 12 together with the drive motor 50, thereby preventing the rotating members from being exposed to view in the vicinity of the operator.

Figure 5:
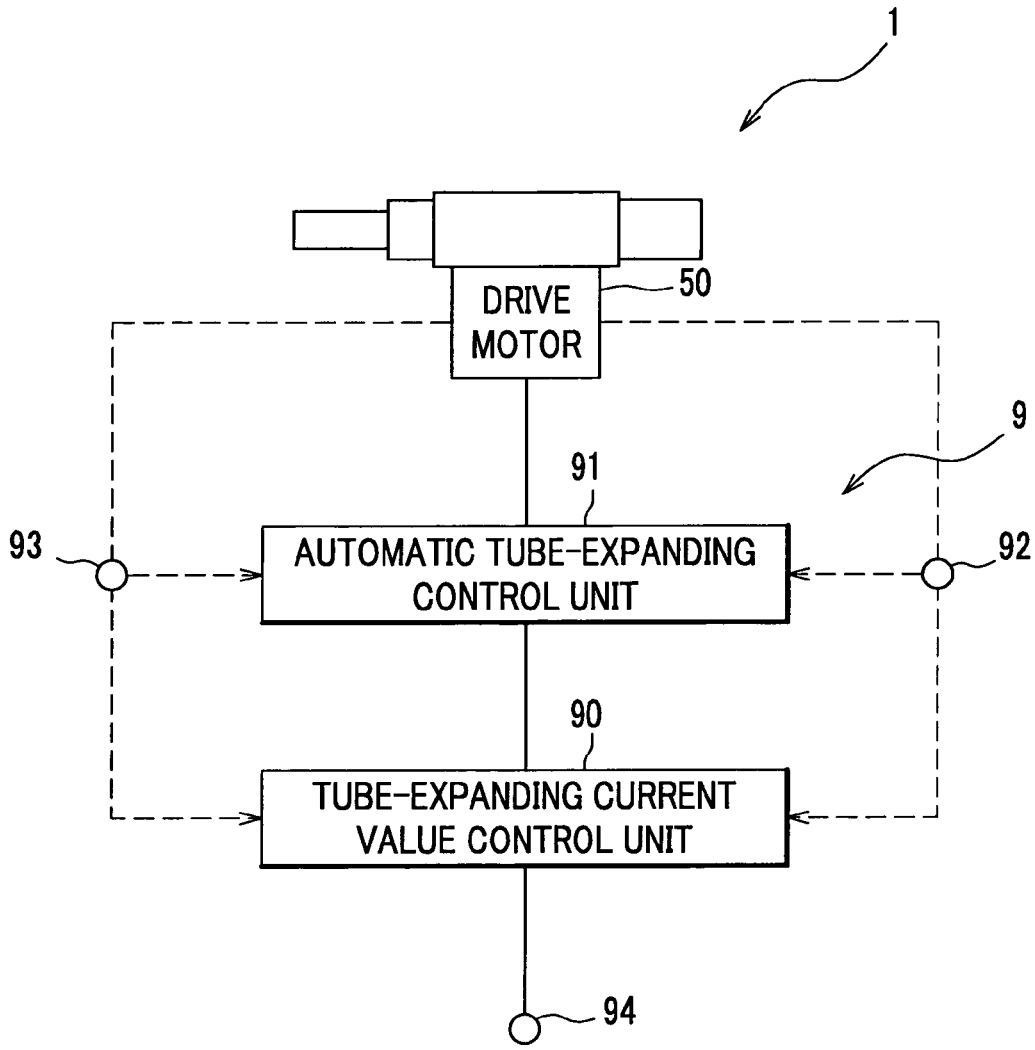
FIG. 5 is a block diagram showing the controller of the tube expanding device.

The drive motor 50 is connected with a controller 9 which controls the drive of the drive motor 50. The controller 9 controls forward and backward movements of the mandrel 4 according to a driving torque by which the mandrel 4 is moved forward relative to the expander frame 3. Specifically, as shown in FIG. 5, the controller 9 detects the value of a current passing through the drive motor 50. The controller 9 includes a tube-expanding current value control unit 90 for controlling a current supply on the basis of a current value detected, and an automatic tube-expanding control unit 91 for switching and controlling the direction of rotation of the drive motor 50.

The tube-expanding current value control unit 90 is connected to a power source 94 and detects a current value that flows to rotate the drive motor 50. When an automatic start switch is pushed, the tube-expanding current value control unit 90 supplies a current to the drive motor 50 while detecting a current for rotating the drive motor 50.

If a current supply is started, the automatic tube-expanding control unit 91 causes the drive motor 50 to rotate. By the rotation of the drive motor 50, the retainer 71 (see FIG. 1) of the roller feed unit 70 makes positive rotation together with the spindle 51, and the mandrel 4 moves forward through the push rod 72 and abuts on the rollers 2. Thereafter, by further rotating the retainer 71 in the clockwise direction (positive rotation), the mandrel 4 is moved forward and the rollers 2 are pushed out outwardly, whereby tube expanding is started. If the tube expansion progresses, a driving torque increases gradually and a current for rotating the drive motor 50 increases. However, when this current value reaches a preset current value, the tube-expanding current value control unit 90 stops the current supply and stops the drive motor 50. The preset current value is a current value that is generated when the tube TU is expanded to a predetermined tube expanding diameter.

Thereafter, after the drive motor 50 is stopped only for a preset period of time (about 1 to 3 seconds), a current supply is restarted by the tube-expanding current value control unit 90. At this time, in response to the stop of the current supply, the automatic tube-expanding control unit 91 switches the rotation of the drive motor 50 to reverse rotation. By supplying current for a predetermined period of time (about 1 to 5 seconds) with the tube-expanding current value control unit 90, the drive motor 50 is reversely rotated and the mandrel 4 is moved backward by a predetermined distance, thereby separating the mandrel 4 from the rollers 2. At this stage, the tube expanding operation is completed.

In FIG. 5, a reference numeral 93 denotes an emergency stop switch. If this emergency stop switch 93 is pushed, the drive motor 50 is stopped. It is noted that when the emergency stop switch 93 is pushed, the drive motor 50 may be slightly and reversely rotated before the stoppage of the drive motor 50.

As shown in FIG. 2, in the tube expanding device 1, a pair of grip handles 14 for the operator are provided on the right and left sides of the base portion 12*a* (housing 12). In front of the grip handles 14, lever members that constitute an automatic start switch 92 and an emergency stop switch 93 are provided. When the operator pulls the lever members toward the grip handles 14, the automatic start switch 92 and emergency stop switch 93 are turned on. In FIGS. 1 and 2, a reference numeral 15 denotes a stopper ring for hanging the main body of the tube expanding device 1. The stopper ring 15 is fixed on the top portion of the housing 12 by bolts (not shown).

Radially outward of the expander frame 3 is provided a collar member 11 that abuts on an end face of the tube TU (tube member to be expanded). The collar member 11 surrounds a part of the body portion of the expander frame 3 and is arranged on the outer peripheral surface of the expander frame 3 with a predetermined gap. The collar member 11 abuts on the end face of the tube TU to thereby restrict an inserted amount of the expander frame 3. The collar member 11 is a cylindrical member and is arranged concentrically with the expander frame 3. The collar member 11 is fixed to the housing 12 as a fixed system, through a collar adapter 110, which covers the rear portion of the expander frame 3 and the front portion of the spindle 51, and a flange 111. The flange 111 is fixed to the housing 12 by means of bolts 112, while the collar adapter 110 is fixed to the flange 111 by means of a key 113 and set screws 114. The collar member 11 is fixed to the collar adapter 110 by means of set screws 114. Therefore, the collar member 11 does not rotate.

Operation of the tube expanding device 1 will be explained by referring to the procedure of the tube expanding operation which employs the tube expanding device 1 constructed as described above.

Initially, an operator grips the grip handles 14, 14 with both hands, and inserts the extreme end portion of the expander frame 3 including the rollers 2 and the mandrel 4, into the tube TU inserted in a tube plate (not shown). At this time, the expander frame 3 is inserted until the collar member 11 abuts on the end face of the tube TU, the inserted length of the expander frame 3 is set to a predetermined length.

Next, the operator pulls the lever member toward the grip handle 14 and turns the automatic start switch 92 on. The tube-expanding current value control unit 90 receives a signal indicating that the automatic start switch 92 is turned on, and in response to this signal, the tube-expanding current value control unit 90 starts the supply of current to the drive motor 50. At the same time, the automatic tube-expanding control unit 91 receives a current supply and rotates the drive motor 50. Therefore, the retainer 71 of the roller feed unit 70 starts the positive rotation, and moves the mandrel 4 forward through the push rod 72 so that the mandrel 4 abuts on the roller 2 (see FIG. 1).

Specifically, when the drive motor 50 rotates, the rotation is sequentially transmitted to the motor shaft 53, the gear 55, the gear 56, and the spindle 51, so that the expander frame 3 fixed to the spindle 51 and the retainer 71 rotate. When the retainer 71 rotates in the positive direction, the rollers 73 revolve along the circumference of the retainer 71. However, since the rollers 73 abut on the abutting member 76, the roller 73 also rotates reversely about its axis. The rotating force of each roller 73 generates not only the rotating force of the push rod 72 but also the forward propulsive force of the push rod 72. Therefore, the push rod 72 is given a forward propulsive force by the rollers 73 and moves forward, while making positive rotation. When the retainer 71 is reversely rotated, the direction of rotation of the roller 73 is reversed (positive rotation) and therefore the push rod 72 moves backward.

According to this preferred embodiment, the moving device 7 is provided for causing the mandrel 4 to abut on the rollers 2. Therefore, unlike the conventional tube expanding tool, it is not necessary for the operator to push the tube expanding device against the tube TU. This makes it possible to reduce the work load of the operator, and further since the mandrel 4 is mechanically abutted on the rollers 2, the mandrel 4 can abut on the rollers 2 with a suitable pressure.

Figure 3:
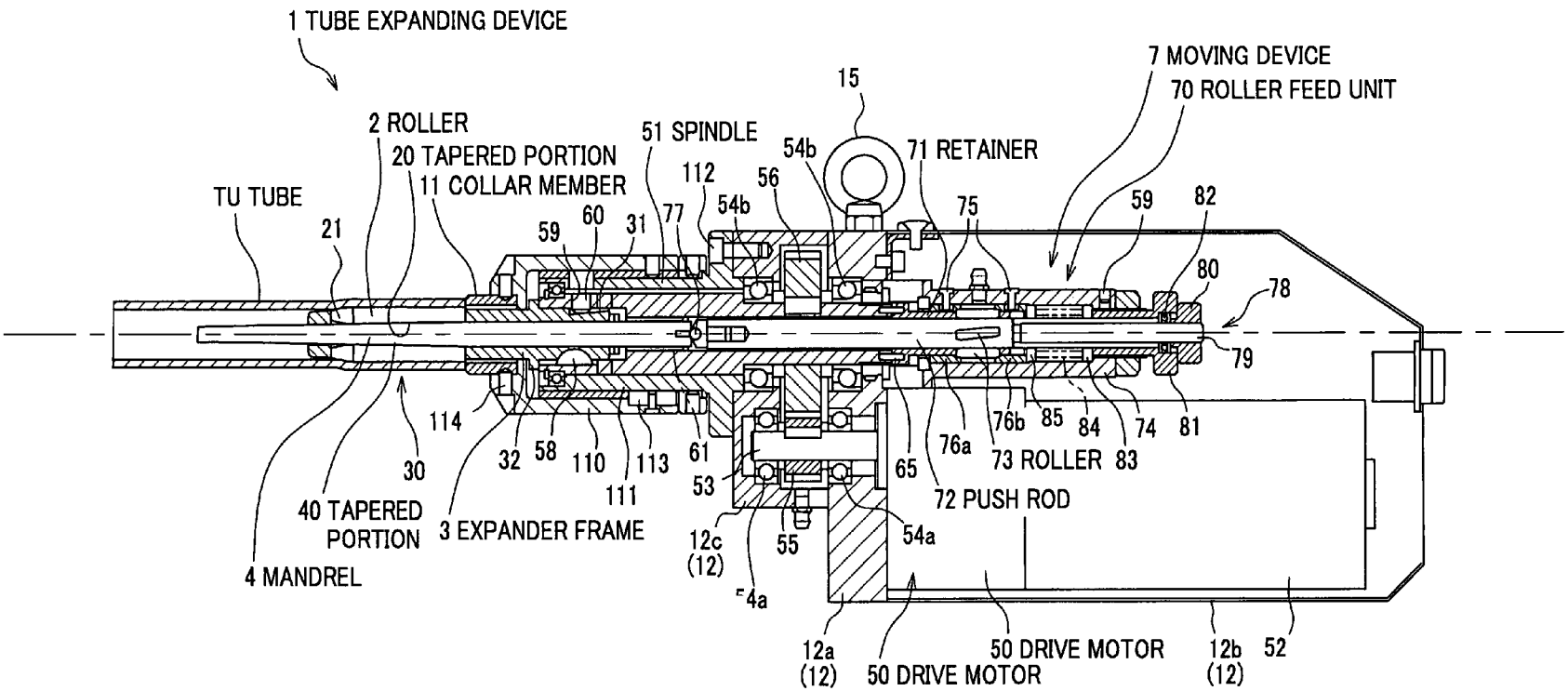
FIG. 3 is a sectional view showing the state in which the mandrel of the tube expanding device has moved forward.

When the mandrel 4 is further moved forward to progress the tube expansion, as shown in FIG. 4, the mandrel 4 pushes out the rollers 2 toward the radially outside of the expander frame 3, and the tube TU is rolled from inside by the rotation of the rollers 2, so that tube expansion is performed. As shown in FIG. 3, as the tube expanding operation progresses, the pressure of pushing the rollers 2 between the mandrel 4 and the tube TU becomes higher. As a result, the driving torque increases gradually and a current for rotating the drive motor 50 increases. When this current value reaches a preset current value, the tube-expanding current value control unit 90 detects the current value and stops the current supply. At this stage, the drive motor 50 is stopped only for a preset period of time (about 1 to 3 seconds) by the tube-expanding current value control unit 90. Thereafter, the automatic tube-expanding control unit 91 supplies a current to the drive motor 50 for a predetermined period of time (about 1 to 5 seconds) and causes the drive motor 50 to rotate in the reverse direction. Therefore, the mandrel 4 is moved backward by a predetermined distance and is separated from the rollers 2.

As described above, after the tube expansion is completed, automatically retracting the mandrel 4 and separating the same from the rollers 2 are fully automated. Therefore, it is not necessary for the operator to separate the mandrel 4 from the rollers 2. When the drive motor 50 is reversely rotated, a self retracting force occurs in the mandrel 4. Although the conventional tube expansion method using rollers requires the operator to pull back a drive machine in order to reversely rotate the mandrel 4, this operation is automatically performed with the present invention, which greatly decreases the work load of the operator.

Once the operator inserts the expander frame 3 into the tube TU, the operator is required to turn on the automatic start switch 92 and no manual operation is required. This can reduce the work load of the operator as well as improve the working efficiency. Further, since the drive motor 50 is stopped according to the driving torque, the tube TU can be expanded to a constant expanded tube diameter and the tube expanding operation can be performed with a high degree of accuracy.

According to this preferred embodiment, since the expander frame 3 is fixed directly to the spindle 51 which constitutes the drive device 5, the rotation speed of the expander frame 3 can be considerably increased when compared with the conventional mechanism. In other words, since conventionally, the mandrel is connected to the drive device and is rotated, the rotation speed of the frame (expander frame) is reduced to about ⅓ to ⅕ by the principles of a planetary gears motion. However, according to the present invention, the expander frame 3 is coupled directly to the spindle 51 which is the drive device 5, and therefore the rotation speed of the spindle 51 is equal to the rotation speed of the expander frame 3. Therefore, the rotation speed of the expander frame 3 according to the present invention is three to five times faster than that of the conventional mandrel rotation system. This makes it possible to greatly reduce the tube expanding time and to perform an efficient tube expanding operation. Further, since a contact turn of the expander frame 3 can be prevented, the tube expanding operation can be performed with a high degree of accuracy.

In the preferred embodiment, since the spindle 51 is fixed at its front portion to the expander frame 3 and at its rear portion to the retainer 71, drive of the moving device 7 (rotation of the roller feed unit 70) and drive of the drive device 5 (rotation of the expander frame 3) can be performed by the same drive source (drive motor 50). Therefore, simplifying the structure, size reduction and weight reduction of the tube expanding device 1, simplifying the control system, and an improvement in reliability can be achieved.

Since the expander frame 3 and retainer 71 are both fixed to the spindle 51, the rotation speed becomes the same. However, the angles of inclination of the rollers 2, 73 are determined such that the forward and backward moving speeds of the mandrel 4 and the forward and backward moving speeds of the push rod 72 become the same. Therefore, even if the mandrel 4 and push rod 72 are coupled together, no problem occurs. The mandrel 4 has the tapered portion 40, and the rotation speed of the mandrel 4 differs from that of the push rod 72. However, since the mandrel 4 and push rod 72 are coupled through the spherical bearing 77, a relative rotation is allowed therebetween.

In this preferred embodiment, since the drive device 5 includes the drive motor 50 and the spindle 51 and the mandrel 4 is inserted in the spindle 51, the spindle 51 and mandrel 4 can be arranged so that they overlap each other in the direction of the length, and the forward and backward strokes of the mandrel 4 can be performed within the drive device 5. Therefore, compared with the conventional tube expanding device in which the drive unit is connected behind the mandrel, the entire length of the tube expanding device 1 can be shortened, whereby a reduction in size and weight of the tube expanding device 1 can be achieved and the working efficiency is greatly improved. Besides, the tube expanding device 1 enables a tube expanding operation in a narrow place.

Since the gear 56 of the spindle 51 is larger in diameter than the gear 55 of the motor shaft 53, the drive device 5 can transmit the rotating force of the drive motor 50 to the spindle 51 while increasing the driving torque. Accordingly, the size of the drive motor 50 can be reduced, which leads to a further decrease in size and weight of the tube expanding device 1.

In the preferred embodiment, since the collar member 11 is fixed to a fixed system, the collar member 11 does not rotate. This can prevent the tube TU which abuts on the collar member 11 from being rotated. Particularly, the tube TU is given a greater turning force by the expander frame 3 which rotates at higher speed than the conventional expander frame. However, since the tube TU is drawn to the collar member 11 by the rollers 2, the turn prevention effect is enhanced. Therefore, the accuracy of the tube expanding operation can be improved. It is also possible to save the work load of the operator for preventing a turn of the tube TU as well as to omit additional members such as an attachment.

According to the tube expanding device 1 of this preferred embodiment, rotating members, such as the drive device 5 and the moving device 7, are enclosed within the housing 12, the collar adapter 110, and the like. Therefore, no interference of these rotating members occurs with the operator and other components during the tube expanding operation, which leads to an improved working efficiency.

Figure 6:
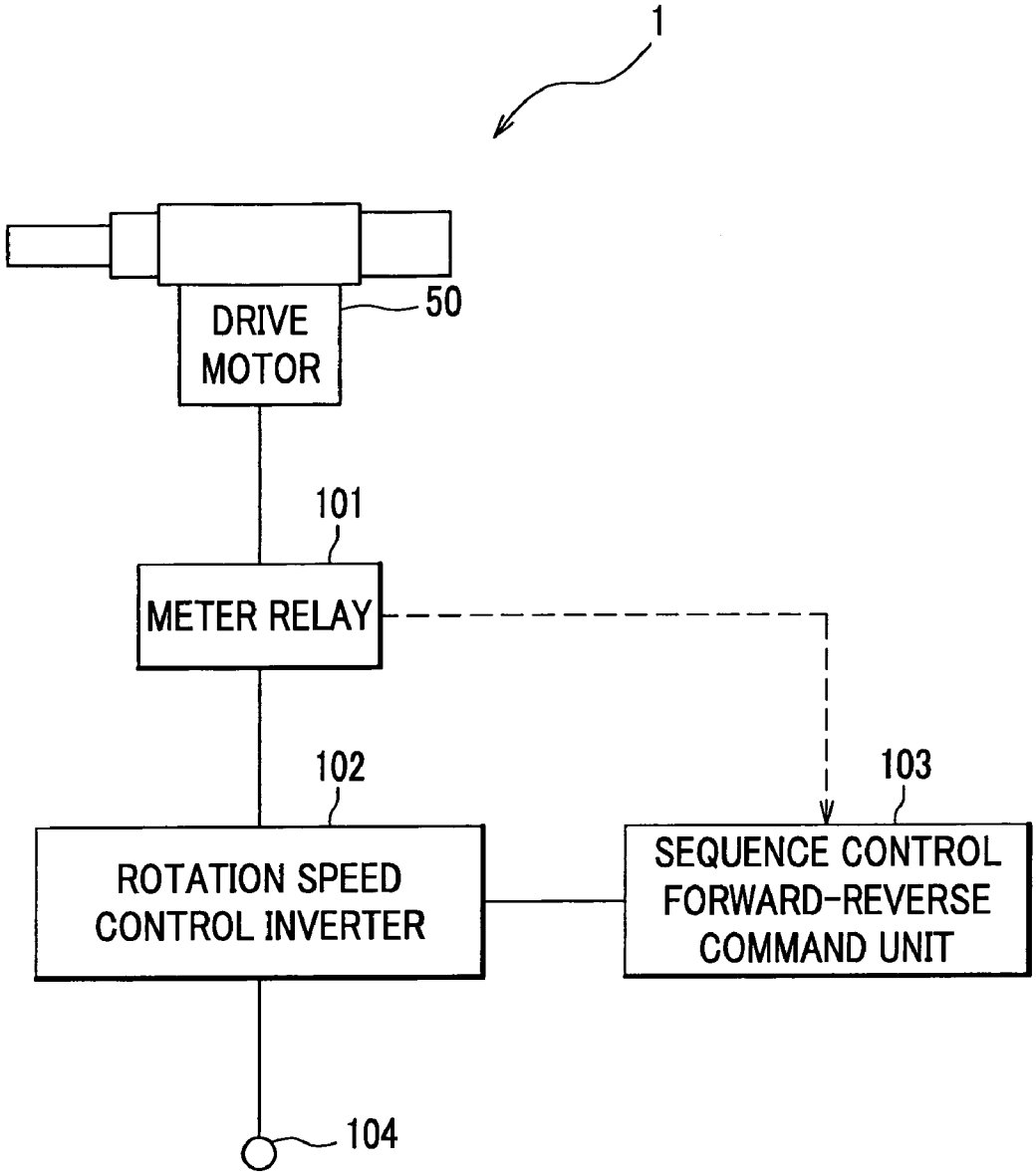
FIG. 6 is a block diagram showing the controller of another tube expanding device according to another preferred embodiment.
Figure 7A:
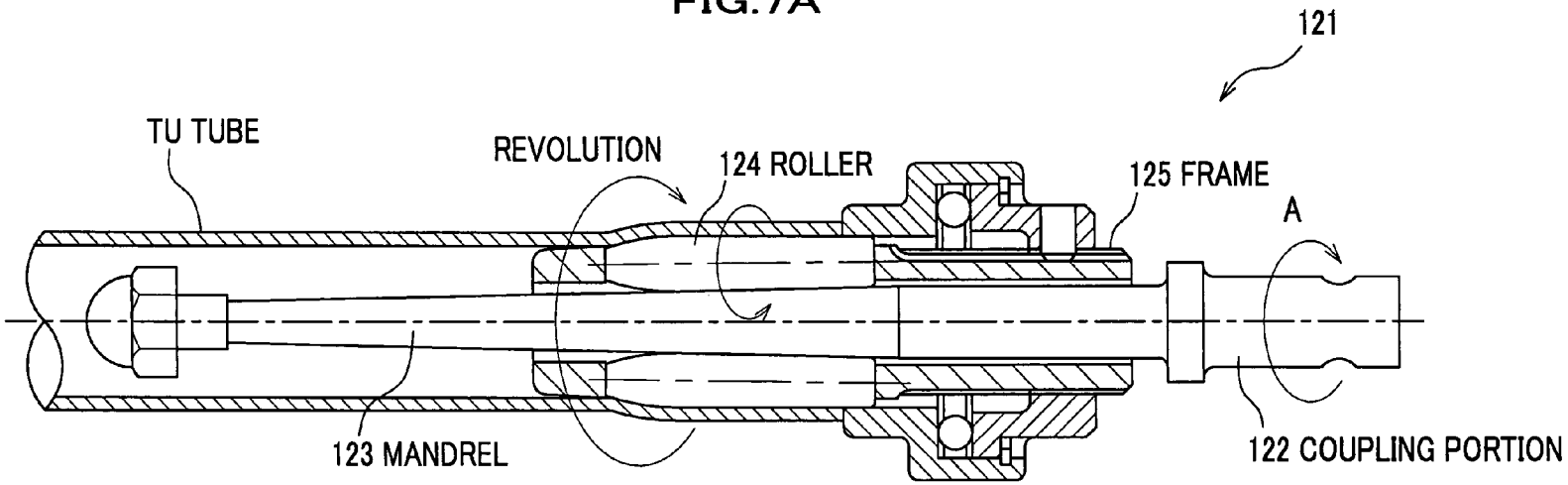
FIG. 7A is a sectional view for explaining a conventional tube expanding tool.
Figure 7B:
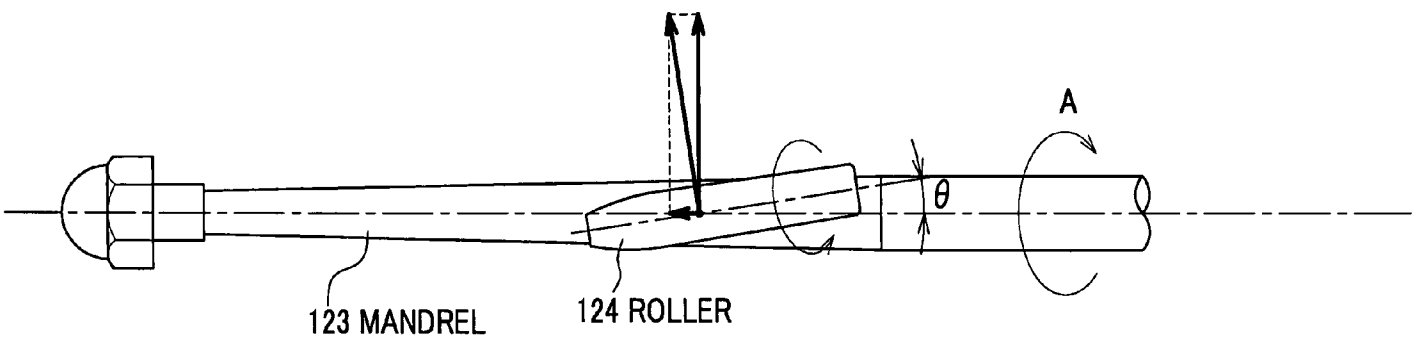
FIG. 7B is a part-plan view showing the positional relation between a roller and a mandrel.

In this preferred embodiment, since the commutator motor 52 is used as the drive motor 50, the controller 9 is constructed as shown in FIG. 5. However, in the case where a three-phase motor is used in the drive motor 50, the controller 9 is constructed as shown in FIG. 6. In this case, the drive motor 50 is connected with a rotation speed control inverter 102 through a meter relay 101 that detects a current value. The rotation speed control inverter 102 is connected with a sequence control forward-reverse command unit 103 and a power source 104. The sequence control forward-reverse command unit 103 switches and controls the direction of rotation of the drive motor 50 according to a current value detected by the meter relay 101.

In the controller 9 constructed as above, a current is supplied according to the rotation speed that is set in the rotation speed control inverter 102. However, as the tube expansion progresses, a driving torque increases gradually and a current for rotating the drive motor 50 increases. When this current value reaches a preset current value, the meter relay 101 detects the current value and transmits a current value detection signal to the sequence control forward-reverse command unit 103. In response to this signal, the sequence control forward-reverse command unit 103 stops the drive motor 50 for a predetermined period of time, and thereafter transmits a signal for reversely rotating the drive motor 50 for a predetermined period of time, to the rotation speed control inverter 102.

While the present invention has been described with reference to the preferred embodiments thereof, the invention is not limited to the details given herein, but may be modified within the scope of the attached claims. For example, in the preferred embodiment, although the moving device 7 employs the roller feed unit 70, the present invention is not limited to this feed unit 70, and a cylinder mechanism, such as an air cylinder, an electric cylinder, and a hydraulic cylinder, may be employed. However, it is preferable to employ the roller feed unit 70, because the roller feed unit 70 can share the drive source with the driving device 5 as well as achieve a simplified drive control, weight reduction of the device, and decreased electric power consumption of the device.

What is claimed is:

1. A tube expanding device comprising:

a plurality of rollers each having a tapered portion whose diameter increases toward its front side;

a cylindrical expander frame for freely rotatably holding the plurality of rollers on a concentric circle;

a mandrel inserted in the expander frame so as to be freely slidable and rotatable relative to the expander frame, and having a tapered portion whose diameter decreases toward its front side, the tapered portion of the mandrel matching the tapered portion of each roller;

a drive device coupled to the expander frame and rotating the expander frame, wherein the drive device generates a driving force that is transmitted to the expander frame without being transmitted through the mandrel; and a moving device for moving the mandrel forward and backward relative to the expander frame, wherein by moving the mandrel forward relative to the expander frame, the tapered portion of the mandrel abuts on the tapered portions of the plurality of rollers and thereby expands a diameter of a circumscribed circle formed by the plurality of rollers.

2. The tube expanding device as set forth in claim 1, wherein the moving device comprises a roller feed unit including:

a cylindrical retainer coupled to the drive device;

a push rod inserted in the retainer, and coupled to the mandrel so as to be freely movable forward and backward together with the mandrel; and a plurality of rollers freely rotatably supported by the retainer, and arranged such that an outer peripheral surface of each roller abuts on an outer peripheral surface of the push rod while an axis of rotation of each roller intersects with an axis of rotation of the push rod.

3. The tube expanding device as set forth in claim 1, further comprising a controller for controlling forward and backward movements of the mandrel according to a driving torque for moving the mandrel forward relative to the expander frame, wherein the controller performs a control of stopping the mandrel for a predetermined period of time and then moving the mandrel backward when the driving torque has reached a predetermined value.

4. The tube expanding device as set forth in claim 2, further comprising a controller for controlling forward and backward movements of the mandrel according to a driving torque for moving the mandrel forward relative to the expander frame, wherein the controller performs a control of stopping the mandrel for a predetermined period of time and then moving the mandrel backward when the driving torque has reached a predetermined value.

5. The tube expanding device as set forth in claim 1, wherein the drive device includes a drive motor, and a cylindrical spindle which is rotated by an output of rotation transmitted from the drive motor; and wherein the mandrel is inserted in the spindle, and the expander frame is fixed to a front portion of the spindle.

6. The tube expanding device as set forth in claim 2, wherein the drive device includes a drive motor, and a cylindrical spindle which is rotated by an output of rotation transmitted from the drive motor; and wherein the mandrel is inserted in the spindle, and the expander frame is fixed to a front portion of the spindle.

7. The tube expanding device as set forth in claim 3, wherein the drive device includes a drive motor, and a cylindrical spindle which is rotated by an output of rotation transmitted from the drive motor; and wherein the mandrel is inserted in the spindle, and the expander frame is fixed to a front portion of the spindle.

8. The tube expanding device as set forth in claim 4, wherein the drive device includes a drive motor, and a cylindrical spindle which is rotated by an output of rotation transmitted from the drive motor; and wherein the mandrel is inserted in the spindle, and the expander frame is fixed to a front portion of the spindle.

9. The tube expanding device as set forth in claim 5, wherein the retainer is fixed to a rear portion of the spindle.

10. The tube expanding device as set forth in claim 6, wherein the retainer is fixed to a rear portion of the spindle.

11. The tube expanding device as set forth in claim 7, wherein the retainer is fixed to a rear portion of the spindle.

12. The tube expanding device as set forth in claim 8, wherein the retainer is fixed to a rear portion of the spindle.

13. The tube expanding device as set forth in claim 1, wherein a collar member which abuts on an end face of a tube member to be expanded is arranged outside the expander frame, with a predetermined gap formed between the collar member and an outer peripheral surface of the expander frame so as to surround the expander frame; and wherein the collar member is fixed to a fixed system.

14. The tube expanding device as set forth in claim 2, wherein a collar member which abuts on an end face of a tube member to be expanded is arranged outside the expander frame, with a predetermined gap formed between the collar member and an outer peripheral surface of the expander frame so as to surround the expander frame; and wherein the collar member is fixed to a fixed system.

15. The tube expanding device as set forth in claim 3, wherein a collar member which abuts on an end face of a tube member to be expanded is arranged outside the expander frame, with a predetermined gap formed between the collar member and an outer peripheral surface of the expander frame so as to surround the expander frame; and wherein the collar member is fixed to a fixed system.

16. The tube expanding device as set forth in claim 4, wherein a collar member which abuts on an end face of a tube member to be expanded is arranged outside the expander frame, with a predetermined gap formed between the collar member and an outer peripheral surface of the expander frame so as to surround the expander frame; and wherein the collar member is fixed to a fixed system.

17. The tube expanding device as set forth in claim 5, wherein a collar member which abuts on an end face of a tube member to be expanded is arranged outside the expander frame, with a predetermined gap formed between the collar member and an outer peripheral surface of the expander frame so as to surround the expander frame; and wherein the collar member is fixed to a fixed system.

18. The tube expanding device as set forth in claim 6, wherein a collar member which abuts on an end face of a tube member to be expanded is arranged outside the expander frame, with a predetermined gap formed between the collar member and an outer peripheral surface of the expander frame so as to surround the expander frame; and wherein the collar member is fixed to a fixed system.

19. The tube expanding device as set forth in claim 9, wherein a collar member which abuts on an end face of a tube member to be expanded is arranged outside the expander frame, with a predetermined gap formed between the collar member and an outer peripheral surface of the expander frame so as to surround the expander frame; and wherein the collar member is fixed to a fixed system.

20. The tube expanding device as set forth in claim 10, wherein a collar member which abuts on an end face of a tube member to be expanded is arranged outside the expander frame, with a predetermined gap formed between the collar member and an outer peripheral surface of the expander frame so as to surround the expander frame; and wherein the collar member is fixed to a fixed system.

21. The tube expanding device as set forth in claim 1, wherein the driving force is a rotary force.

22. The tube expanding device as set forth in claim 21, wherein the rotary driving force rotates the rollers about the mandrel.

* * * * *